US005135008A

United States Patent [19]

Oesterling et al.

[11] Patent Number: 5,135,008

[45] Date of Patent: Aug. 4, 1992

[54] METHOD OF AND APPARATUS FOR MAKING FILTER CIGARETTES

[75] Inventors: Erwin Oesterling, Glinde; Werner Hinz, Lauenburg; Siegfried Schlisio, Geesthacht, all of Fed. Rep. of Germany

[73] Assignee: Körber AG, Hamburg, Fed. Rep. of Germany

[21] Appl. No.: 671,269

[22] Filed: Mar. 18, 1991

[30] Foreign Application Priority Data

Mar. 16, 1990 [DE] Fed. Rep. of Germany ..... 4008475

[51] Int. Cl.[5] ..... A24C 5/47

[52] U.S. Cl. ..... 131/94; 131/84.4; 131/88; 198/462; 198/450

[58] Field of Search ..... 131/84.4, 88, 94; 198/462, 450

[56] References Cited

U.S. PATENT DOCUMENTS

| | | | |
|---|---|---|---|
| Re. 25,917 | 11/1965 | Selzer . | |
| 2,781,886 | 2/1957 | Stelzer . | |
| 3,142,372 | 7/1964 | Wiese . | |
| 3,164,243 | 1/1965 | Rudszinat . | |
| 3,176,825 | 4/1965 | Rudszinat . | |
| 3,215,250 | 11/1965 | Schubert . | |
| 3,340,757 | 9/1967 | Rudszinat . | |
| 3,400,857 | 9/1968 | Schubert . | |
| 3,483,873 | 12/1969 | Hinzmann . | |
| 3,527,234 | 9/1970 | Hinzmann . | |
| 3,583,546 | 6/1971 | Koop . | |
| 3,586,006 | 6/1971 | Wendt . | |
| 3,885,683 | 5/1975 | Bornfleth . | |
| 4,063,480 | 12/1977 | Hinzmann . | |
| 4,090,602 | 5/1978 | Schubert . | |
| 4,149,547 | 2/1981 | Hinzmann . | |
| 4,193,409 | 3/1980 | Wahle . | |
| 4,196,740 | 4/1980 | Rudazinat | 131/84.4 |
| 4,277,678 | 7/1981 | Wahle . | |
| 4,339,026 | 7/1982 | Bäse . | |
| 4,365,702 | 12/1982 | Tolasch . | |
| 4,605,014 | 8/1986 | Wahle . | |
| 4,645,921 | 2/1987 | Heitmann . | |
| 4,648,412 | 3/1987 | Heitmann . | |
| 4,662,214 | 5/1987 | Heitmann . | |
| 4,823,932 | 4/1989 | Hinz . | |
| 4,825,883 | 5/1989 | Hinz . | |
| 4,827,947 | 5/1989 | Hinz . | |
| 4,841,993 | 6/1989 | Hinz . | |
| 4,901,860 | 2/1990 | Wahle . | |
| 4,969,551 | 11/1990 | Heitmann . | |

FOREIGN PATENT DOCUMENTS

| | | |
|---|---|---|
| 2020138 | 11/1970 | Fed. Rep. of Germany . |
| 3623129 | 1/1987 | Fed. Rep. of Germany . |

*Primary Examiner*—V. Millin
*Assistant Examiner*—Lynne A. Reichard
*Attorney, Agent, or Firm*—Peter K. Kontler

[57] ABSTRACT

Filter cigarettes are mass-produced in a machine wherein parallel groups of coaxial plain cigarettes and filter plugs are moved at right angles to their axes through a first station wherein their components are connected to each other by uniting bands, thereupon through a second station wherein the resulting filter cigarettes of double unit length are severed midway across their filter plugs to yield pairs of filter cigarettes of unit length which advance in two rows and are mirror images of each other, and through a third station wherein the filter cigarettes of one row are turned end-for-end and placed between successive non-inverted filter cigarettes. The mutual spacing of groups, filter cigarettes of double unit length and/or of filter cigarettes of unit length is reduced at least once, preferably twice, namely the first time between the first and second stations and the second time at the third station. This results in the formation of a single row of filter cigarettes wherein the spacing between neighboring cigarettes is zero or close to zero. The mutual spacing of groups is not increased between the first and second spacing-reducing stations and/or downstream of the second spacing-reducing station.

36 Claims, 4 Drawing Sheets

A
x
x
$d_{1m}$
$d_1$
3
D
7b
7a
a
16
22
29
$d_{2m}$
$d_2$
29/16
33
38b
38a
b
41a
116
42a
$d_3$
$d_{3m}$

METHOD OF AND APPARATUS FOR MAKING FILTER CIGARETTES

BACKGROUND OF THE INVENTION

The invention relates to improvements in methods and apparatus for making rod-shaped articles of the tobacco processing industry. More particularly, the invention relates to improvements in methods and apparatus for making rod-shaped articles of the type wherein two or more rod-shaped components are joined end-to-end, for example, by uniting bands customarily used in filter tipping machines. Typical examples of rod-shaped articles which can be produced in accordance with the method and in the apparatus of the present invention are filter cigarettes, cigar, cigarillos, stogies and cheroots as well as composite filters and mouthpieces for tobacco smoke. The following description will deal primarily with the making of filter cigarettes; however, the same method and the same apparatus can be resorted to for the making of aforementioned composite rod-shaped articles other than filter cigarettes.

A modern filter tipping machine (e.g., the machine known as MAX 90 which is produced and distributed by the assignee of the present application) is designed to simultaneously produce a plurality of filter cigarettes of unit length. Reference may be had, for example to U.S. Pat. Nos. 4,823,932, 4,825,883 and 4,841,993 to Hinz et al. To this end, the machine is provided with devices which accumulate a series of rod-shaped articles (including pairs of plain cigarettes of unit length and a filter plug of double unit length between the plain cigarettes) into spaced-apart parallel groups each of which contains several coaxial rod-shaped articles. The groups are conveyed sidewise or sideways (namely at least substantially at right angles to their axes) and are connected to each other by uniting bands (e.g., each such group can constitute a filter cigarette of double unit length). Successive groups (wherein the components are connected to each other) are subdivided into pairs of discrete rod-shaped articles (such as pairs of filter cigarettes of unit length). The discrete articles of each pair are mirror images of each other and, therefore, the machine is provided with a turn-around device or inverting means serving to turn one discrete article of each pair end-for-end and to place the inverted article between a pair of non-inverted articles so that the inverted and non-inverted articles form a single stream which can be admitted into storage, into a packing machine or delivered to another station.

Simultaneous making of pairs of discrete rod-shaped articles (such as filter cigarettes of unit length) is desirable and advantageous because the output of the machine is doubled. The spacing of successive groups and successive discrete articles from each other (as measured at right angles to the axes of the groups and articles) is determined by the maximum spacing which is required in connection with a particular operation during assembly of the groups, during connection of components of successive groups to each other, during severing or subdivision of the groups into pairs or larger numbers of discrete articles or during treatment of discrete articles. Such spacing is maintained from the beginning to end, i.e., from the locus of assembly of groups of coaxial rod-shaped components to the locus where the finished products leave the machine.

Published German patent application No. 35 23 129 discloses a tipping machine with two mechanisms (called rolling units) which are used to connect successive groups of two or more coaxial rod-shaped articles to each other by means of adhesive-coated uniting bands. The speed of groups which are about to be provided with and surrounded by adhesive-coated uniting bands is reduced to approximately one-third of the initial speed, and successive decelerated groups are alternately delivered to the first and second rolling units to be thereupon reassembled into a single row of groups each having two or more interconnected components. The speed of the groups is increased back to the initial speed as soon as they are reassembled downstream of the two rolling units.

Commonly owned U.S. Pat. No. 4,827,947 to Hinz discloses a filter tipping machine wherein the mutual spacing of successive articles is reduced for the purpose of making air-admitting openings (perforations) in their tubular wrappers. However, and as can be seen in FIG. 2 of the patent, the initial spacing is restored as soon as the rod-shaped articles advance beyond the perforating station.

OBJECTS OF THE INVENTION

An object of the invention is to provide a novel and improved method of making high-quality filter cigarettes and analogous rod-shaped products of the tobacco processing industry at a rate which is higher than in accordance with heretofore known methods.

Another object of the invention is to provide a method of treating rod-shaped articles and products of the tobacco processing industry gently so that the number of rejects is minimal.

A further object of the invention is to provide a novel and improved method of making, treating and transporting composite rod-shaped articles and products of the tobacco processing industry.

An additional object of the invention is to provide a method which renders it possible to convert a single layer of parallel rod-shaped products of the tobacco processing industry into a mass flow without deformation of and/or other damage to such products.

Still another object of the invention is to provide a novel and improved method of manipulating constituents of and finished filter cigarettes in a filter tipping machine.

A further object of the invention is to provide a method which renders it possible to increase the output of a filter tipping machine or an analogous machine without increasing the speed of rod-shaped constituents of filter cigarettes and/or of the finished products.

Another object of the invention is to provide a method which renders it possible to establish more favorable circumstances for testing of filter cigarettes or analogous rod-shaped products of the tobacco processing industry.

An additional object of the invention is to provide a method which renders it possible to treat filter cigarettes and their components gently even if the speed of filter cigarettes and their components exceeds that of filter cigarettes and components in heretofore known filter tipping or analogous machines.

Still another object of the invention is to provide a novel and improved machine or apparatus for the practice of the above outlined method.

A further object of the invention is to provide a filter tipping machine wherein the number of rejects does not exceed the number of rejects in a conventional machine even though the output of the novel filter tipping machine is higher or even much higher than the output of presently available machines.

Another object of the invention is to provide a machine or apparatus for the making of filter cigarettes or other composite rod-shaped products of the tobacco processing industry with novel and improved means for altering the spacing of successive articles or groups of articles from one another.

An additional object of the invention is to provide the above outlined machine with novel and improved means for ensuring that the output of the machine is not lower than that of the fastest presently known machines but the articles can be transported at a lower speed with attendant reduction of the likelihood of damage to the articles during assembly into groups and during further treatment on their way toward storage or into a packing machine.

A further object of the invention is to provide the machine with novel and improved means for establishing optimal circumstances for multiple and reliable testing of rod-shaped products.

Another object of the invention is to provide the machine with novel and improved means for transporting rod-shaped articles, groups of rod-shaped articles and finished rod-shaped products through a plurality of successive stations.

An additional object of the invention is to provide an apparatus which can turn out large numbers of superior rod-shaped products of the tobacco processing industry per unit of time irrespective of whether the diameters of the articles approach or match the upper or lower limit of a rather wide range of different diameters.

A further object of the invention is to provide a production line including cigarette rod making machine and machine of the above outlined character.

Another object of the invention is to provide the above outlined machine or apparatus with novel and improved means for forming a stream of closely adjacent parallel rod-shaped articles.

An additional object of the invention is to provide the above outlined machine or apparatus with novel and improved means for accumulating and advancing a mass flow of rod-shaped products of the tobacco processing industry without any, or without appreciable, damage to or deformation of the products.

A further object of the invention is to provide the above outlined machine or apparatus with novel and improved means for reorienting and transporting rod-shaped products, such as filter cigarettes of unit length, in a gentle and time- and space-saving manner.

Another object of the invention is to provide a machine or apparatus which can turn out filter cigarettes or analogous composite rod-shaped products of the tobacco processing industry at a rate at least matching the output of conventional machines or apparatus even though the quality of products which are turned out in the improved machine or apparatus is superior to that of products which are turned out by conventional machines.

SUMMARY OF THE INVENTION

One feature of the present invention resides in the provision of a method of making rod-shaped products of the tobacco processing industry, such as filter cigarettes the steps of cigarillos. The method comprises the steps of groups each of which is composed of several coaxial rod-shaped articles, conveying the groups sidewise (i.e., at least substantially at right angles to the axes of their cigarettes) in a predetermined direction along an elongated path, connecting the articles of successive groups to each other with uniting bands in a first portion of the path, subdividing successive groups of connected articles into pairs of discrete first and second rod-shaped articles in a second portion of the path downstream of the first portion so that the first articles form a first row having a first orientation and the second articles form a second row having a different second orientation (as a rule, each second article is a mirror image of the respective first cigarette), and changing the orientation of discrete articles in one of the rows and shuffling the reoriented articles with the articles of the other row to form a single row of discrete articles in a third portion of the path downstream of the second portion. In accordance with a feature of the method, the conveying step includes reducing, at least once, the spacing of successive articles in the path and thereupon transporting the articles at the reduced spacing from one another.

The reducing step can be carried out in several successive stages including a first stage of reducing the spacing of successive articles to a first extent and a second stage of further reducing the once reduced spacing. The groups in the first portion of the path are spaced apart from one another a first distance, and the first stage can include reducing the first distance to a second distance substantially half the first distance. The second stage can include reducing the second distance to a third distance substantially half the second distance.

The method can be practiced to make rod-shaped products with a diameter D in the range of $D_1$ to $D_2$ (e.g., between 7 and 9 mm in the case of filter cigarettes). The groups in the first portion of the path can be spaced apart from each other a distance which is greater than $D_2$, and the reducing step can include reducing or shortening the first distance to a second distance which at least approximates or at most only slightly exceeds $D_2$.

The reducing step (or one stage of the reducing step) can be carried out in a further portion of the path between the first and second portions, i.e., subsequent to the connecting step but prior to the subdividing step. For example, such reducing step (or the one stage of the reducing step) can include transporting successive articles on a first rotary conveyor (e.g., a drum-shaped or cylindrical conveyor) at a first distance (or pitch) from each other and transferring successive articles from the first conveyor onto a second rotary conveyor (e.g., a second drum-shaped or cylindrical conveyor). The transferring step includes moving successive articles in a direction with a component radially of the first conveyor and a component radially of the second conveyor to thereby reduce the first distance to a shorter second distance.

The method can further comprise the steps of moving at least one article of each pair of discrete first and second cigarettes axially and away from the other cigarette of each pair in another portion of the path prior to the shuffling step, and thereupon monitoring at least one characteristic of successive discrete articles in each of the rows. The monitoring step can include monitoring several different characteristics of successive discrete articles in each of the rows in a plurality of successive steps or stages. If the reducing step is carried out in a plurality of stages, one such stage can be carried out prior and another stage can be carried out subsequent to the monitoring step. The other stage can include reducing the spacing of successive articles at least close to zero, and such other stage can be carried out simultaneously with the shuffling step. For example, the other stage can involve placing successive reoriented discrete articles of the one row between pairs of successive discrete articles in the other row or vice versa.

Another feature of the invention resides in the provision of an apparatus for making rod-shaped products of the tobacco processing industry, such as filter cigarettes or composite filter plugs. The improved apparatus can constitute a filter tipping machine and comprises means for accumulating a series of spaced-apart parallel groups of several coaxial rod-shaped articles (e.g., each such group can comprise a pair of plain cigarettes of unit length and a filter plug of double unit length between them), means for conveying the groups sidewise (namely substantially at right angles to their axes) in a predetermined direction along an elongated path, means for connecting the articles of successive groups to each other with uniting bands or in an analogous way in a first portion of the elongated path, means for subdividing successive groups of connected articles into pairs of discrete first and second rod-shaped articles (e.g., into pairs of filter cigarettes of unit length which are mirror images of each other because the groups of connected articles are severed midway across their filter plugs of double unit length) in a second portion of the path downstream of the first portion so that the first articles form a first row of articles having a first orientation and the second articles form a second row of articles having a different second orientation, and means for changing the orientation of discrete articles in one of the two rows and for shuffling the thus reoriented articles of the one row with the non-reoriented articles of the other row to form a single row of discrete articles in a third portion of the path downstream of the second portion. In accordance with a feature of the invention, the conveying means includes means for reducing—at least once—the spacing of successive articles (as measured in the predetermined direction) in the path. The conveying means preferably further includes means for transporting the articles are not more than the reduced spacing in all portions of the path downstream of the reducing means.

The accumulating means can comprise at least two sources of different rod-shaped articles, an assembly unit (e.g., a rotary drum-shaped conveyor) and means for delivering articles from the sources to the assembly unit.

The reducing means can comprise a plurality of reducing devices including a first reducing device which is nearer to the first portion of the path and a second reducing device which is nearer to the third portion of the path. One of these reducing devices (e.g., the first reducing device or the sole reducing device if the reducing means comprises a single reducing device) can comprise a first circulating conveyor having a plurality of equidistant first peripheral receptacles for rod-shaped articles and a second circulating conveyor having a plurality of equidistant second receptacles for rod-shaped articles. The second receptacles are nearer to each other than the first receptacles, and the conveyors define a transfer zone or transfer station wherein rod-shaped articles are transferred from successive first receptacles into successive second receptacles. The conveyors are preferably rotatable about parallel axes and the receptacles are preferably parallel to the axes of such rotary conveyors.

The apparatus can be designed to make rod-shaped products with a diameter D in the range between $D_1$ (minimum diameter) and $D_2$ (maximum diameter). The axes of the articles in the equidistant second receptacles can be spaced apart from each other a distance which approximates or only slightly exceeds $2D_2$. The distance between rod-shaped articles in neighboring second receptacles can approximate or only slightly exceed $D_2$.

A first and a second receptacle at the aforementioned transfer zone can be spaced apart from each other a distance which is greater than D (wherein D is the diameter of rod-shaped articles which are being transferred form the first conveyor onto the second conveyor).

The first conveyor can include or constitute a rotary drum and its (first) receptacles can constitute shallow flutes which are provided in the periphery and are parallel to the axis of the drum. The latter is preferably provided with suction ports which serve to attract the articles into the flutes in certain angular positions of the respective flutes. The second conveyor can also constitute or include a (second) rotary drum, and the second receptacles can constitute (second) flutes which are provided in the periphery and are parallel to the axis of the second drum. The second drum is rotatable in a preselected direction (such as clockwise if the drum of the first conveyor is rotated counterclockwise or vice versa) and comprises substantially tangential first flanks which bound the upstream portions of the second flutes (as seen in the preselected direction) and substantially radial second flanks which bound the downstream portions of the second flutes.

A reducing device of the reducing means (such as the aforediscussed device with two rotary conveyors) can be disposed in a further portion of the path between the first and second portions to reduce the spacing between successive groups of connected articles prior to subdivision of groups into pairs of discrete articles. Such apparatus can further comprise means (e.g., in the form of spreading cams, rollers or the like) for moving at least one article of each pair of discrete articles axially and away from the other article of the respective pair to thus establish a gap between the articles of the first and second rows in an additional portion of the path between the second and third portions. The establishment of such gap is particularly desirable and advantageous if the apparatus further comprises means for monitoring the characteristics of discrete articles because a first monitoring means can be set up to monitor the characteristics of successive discrete articles in the first row and a second monitoring means can be set up to monitor the characteristics of successive discrete articles in the second row. The first and second monitoring means can be installed in the elongated path between the additional portion and the third portion.

As mentioned above, the reducing means can comprise a plurality of reducing devices which are spaced apart from each other in the predetermined direction. A first reducing device can be provided with means (such as the aforementioned first and second conveyors) for reducing substantially in half the spacing of successive articles in a portion of the path which is nearer to the first than to the third portion, and a second reducing device can be provided with means for reducing substantially in half the once-reduced spacing of successive articles in a portion of the path which is nearer to the third than to the first portion. The single reducing means or the last reducing device of a composite reducing means can be provided with means for reducing the spacing between successive articles to zero or at least close to zero.

The single reducing means or one of plural reducing devices can be installed downstream of that (another or fourth) portion of the path wherein the discrete articles of the two rows are monitored by first and second monitoring means.

The reducing device downstream of the monitoring means can include a portion of or the entire shuffling means, and such shuffling means can include means for transferring reoriented articles of the one row into the other row. The spacing of articles in the other row (at least in the region of the shuffling means) at least equals the diameters of the articles in the one row in order to establish room for the transfer of reoriented articles of the one row into the other row.

The reducing device downstream of the monitoring means can comprise a cylindrical conveyor which serves to transfer articles of the one row to the orientation changing means, and the orientation changing means can comprise cooperating conical conveyors (for example, two conical conveyors with their axes disposed at an angle of 90°) having flutes or other suitable means for inverting the articles of the one row end-for-end and for delivering inverted articles of the one row to the shuffling means. The flutes of the conical conveyors can be designed to move the articles of the one row axially or with an axial component into alignment with the articles of the other row in the course of inversion of articles of the one row end-for-end.

The conveying means can comprise a further conveyor (e.g., a rotary cylindrical or drum-shaped conveyor) having means (e.g., axially parallel peripheral flutes) for receiving the articles of the other row as well as the inverted and axially shifted articles of the one row. The shuffling means can further comprise a conveyor which delivers the articles of the other row to the further conveyor. The flutes of the further conveyor are distributed in such a way that they can receive discrete articles of the other row as well as the inverted and axially shifted articles of the one row.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
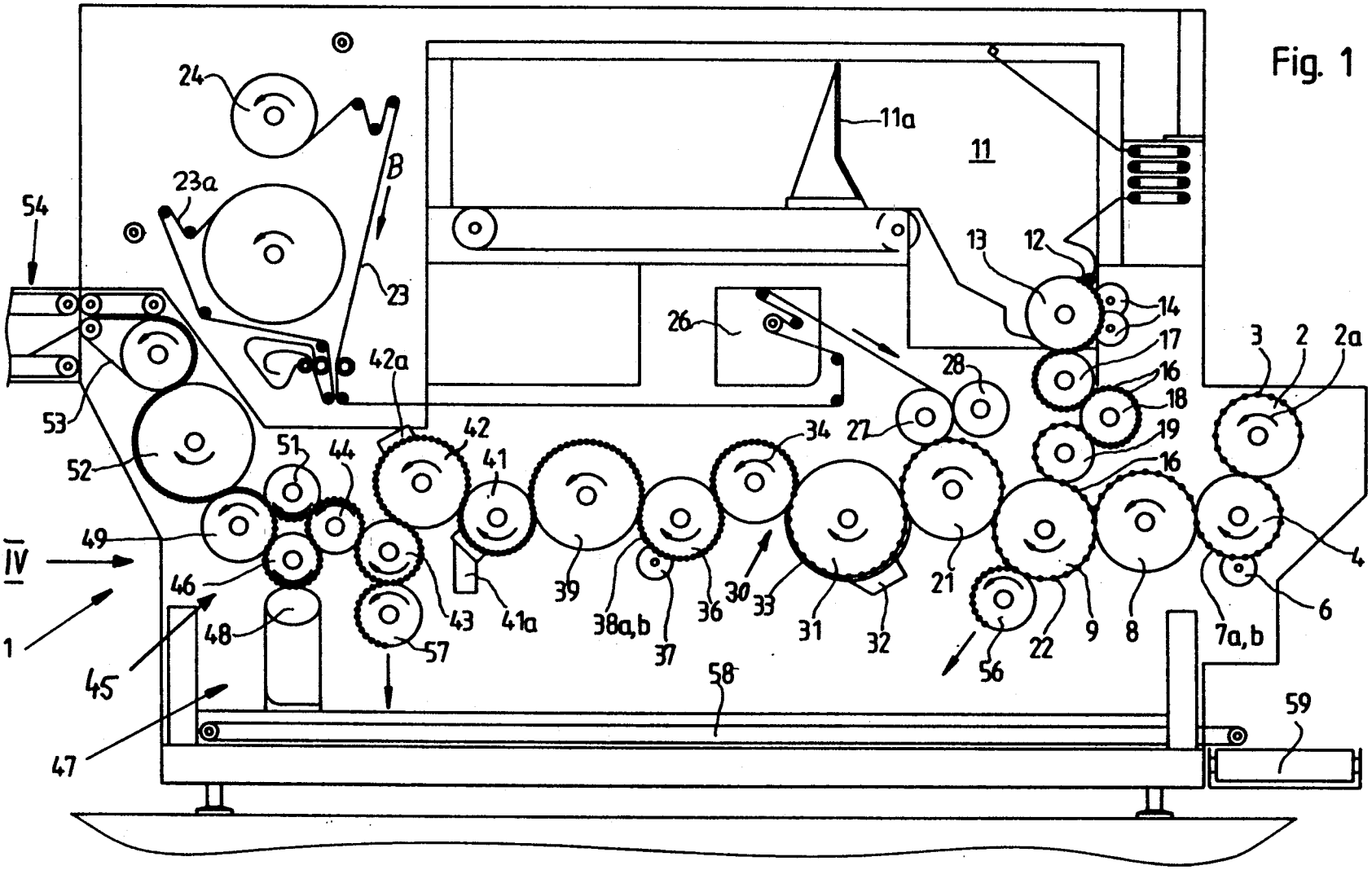
FIG. 1 is a schematic front elevational view of an apparatus which constitutes a filter tipping machine and embodies one form of the invention.
Figure 3:
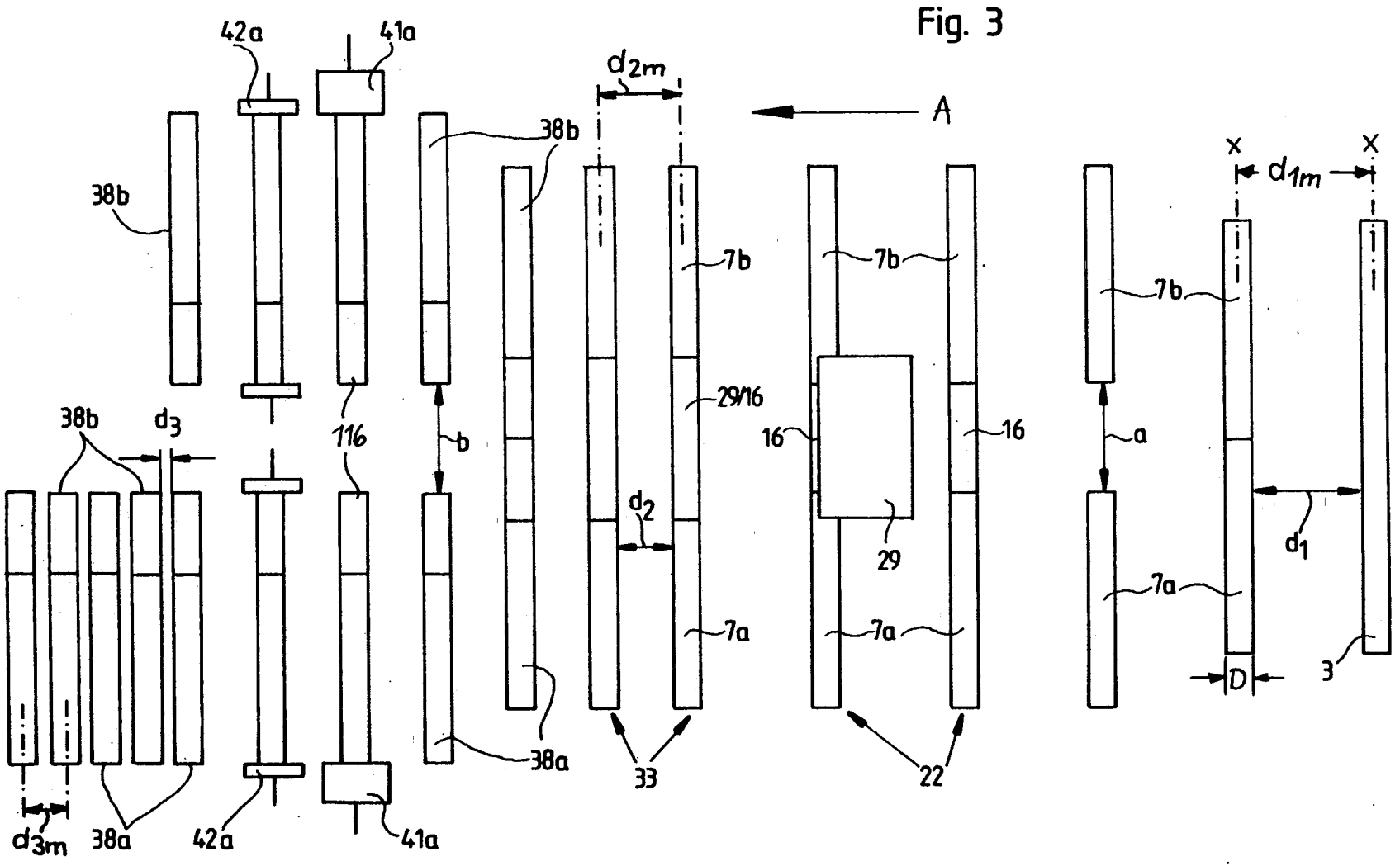
FIG. 3 is a diagram showing a series of groups and discrete rod-shaped articles during different stages of transport through the apparatus of FIG. 1.

The apparatus 1 of FIG. 1 is a filter tipping machine which turns out a single row of rod-shaped products of the tobacco processing industry, namely filter cigarettes 38*a*, 38*b* of unit length (see the left-hand portion of FIG. 3). The description of the apparatus 1 (as shown in FIG. 1) will be made with continuous reference to FIG. 3 which shows successive steps of transforming at least two different rod-shaped articles or components 7*a*, 7*b* and 16 into groups 22 of coaxial but yet unconnected articles, of thereupon transforming the groups 22 into groups 33 of connected or coherent rod-shaped articles, of transforming the groups 33 into pairs of coaxial filter cigarettes 38*a*, 38*b* of unit length, and of converting the pairs of coaxial filter cigarettes into a single row or stream wherein the filter cigarettes 38*a* preferably alternate with the filter cigarettes 38*b*.

The apparatus 1 comprises a rotary drum-shaped transfer conveyor 2 which is driven to rotate in the direction of arrow 2*a* and can be said to simultaneously form part of a cigarette rod making machine (e.g., a machine known as PROTOS which is made and distributed by the assignee of the present application) and has axially parallel peripheral article receiving means in the form of flutes (not referenced) for advancement of a series of successive equidistant plain cigarettes 3 of double unit length. The cigarettes 3 are conveyed sideways or sidewise, i.e., at right angles to their respective axes, in a direction as indicated in FIG. 3 by arrow A. This also applies for all other-rod-shaped articles and for the ultimate rod-shaped products 38*a*, 38*b* which are transported in the apparatus 1 from the cigarette rod making machine (i.e., from the conveyor 2) to the discharge end of the apparatus 1, as at 54. In addition to being conveyed sideways, certain rod-shaped articles are also moved axially toward or away from each other, all as will be explained in greater detail hereinafter.

The mutual spacing of neighboring plain cigarettes 3 of unit length on the conveyor 2 equals $d_1$, and the mutual spacing of the axes X of neighboring cigarettes 3 equals $d_{1m}$ wherein $d_{1m}d_1+D$ (D is the diameter of a cigarette 3 33, 38*a* or 38*b*). The conveyor 2 delivers successive plain cigarettes 3 of a series of equidistant cigarettes into successive axially parallel peripheral flutes of a rotary drum-shaped cutting or severing conveyor 4 which cooperates with a rotary circular disc-shaped knife 6 to divide each cigarette 3 into two identical coaxial plain cigarettes 7*a*, 7*b* of unit length. Successive pairs of coaxial plain cigarettes 7*a*, 7*b* are transferred into successive axially parallel peripheral flutes of a rotary drum-shaped spreading or distancing conveyor 8 which cooperates with pneumatic and/or mechanical means for moving the plain cigarette 7*a* and/or 7*b* axially and away from the other plain cigarette and to thus establish an axial clearance or gap a having a width which at least matches the axial length of a rod-shaped cylindrical filter plug 16 of double unit length. The thus obtained pairs of coaxial but axially spaced apart plain cigarettes 7*a*, 7*b* are transferred into successive axially parallel flutes of a rotary drum-shaped assembly conveyor or unit 9. The conveyors 4, 8 together constitute a means for delivering rod-shaped articles 7*a*, 7*b* (plain cigarettes of unit length) of a first type into successive flutes of the assembly conveyor 9. The mutual spacing of peripheral flutes of the conveyors 4, 8 and 9 is the same as that of the flutes at the periphery of the conveyor 2, i.e., the pitch (namely the distance between the centers) of such flutes is $d_{1mm}$.

Spreading conveyors which can be used (at 8) in the apparatus of the present invention are disclosed, for example, in U.S. Pat. No. 2,781,886 to Stelzer, in U.S. Pat. No. Re. 25,917 to Stelzer and in U.S. Pat. No. 3,142,372 to Wiese to which reference may be had, if necessary. Unless otherwise stated, all conveyors which are used in the apparatus 1 of FIG. 1 are rotary drum-shaped (cylindrical) conveyors which rotate about parallel (normally horizontal) axes and have axially parallel peripheral article receiving means in the form of flutes communicating with suction ports and/or cooperating with mechanical retaining devices (such as shrouds) to ensure reliable retention of rod-shaped articles or groups of rod-shaped articles in their flutes during certain stages of each revolution of the respective rotary drum-shaped conveyor.

The conveyor 2 can be said to constitute a source of rod-shaped articles 3 and 7*a*, 7*b*, and a magazine 11 atop the frame of the apparatus 1 constitutes a source of rod-shaped articles 16, i.e., of filter plugs of double unit length. Actually, the magazine 11 contains a supply of parallel filter rod sections or filter plugs 12 of six times unit length, and such filter plugs are caused or permitted to descend into the flutes of a combined rotary withdrawing and severing or cutting conveyor 13. The conveyor 13 cooperates with two axially staggered rotary circular disc-shaped knives 14 to subdivide successive filter plugs 12 into sets of three coaxial filter plugs 16 of double unit length. The conveyor 13 delivers successive sets of three filter plugs 16 each into successive flutes of a staggering conveyor 17 which can comprise three coaxial disc-shaped conveyors driven at different speeds and/or are otherwise capable of staggering successive sets of three coaxial filter plugs 16 in such a way that the staggered plugs are spaced apart from each other in the circumferential direction of the conveyor 17. Reference may be had to U.S. Pat. No. 3,164,243 to Rudszinat et al. The thus staggered filter plugs 16 of double unit length are transferred into successive flutes of a shuffling conveyor 18 (each flute of the conveyor 18 contains a single plug 16) which cooperates with stationary cams (see the U.S. Pat. No. 3,400,857 to Schubert and the U.S. Pat. No. 3,164,243 to Rudszinat) and/or with pneumatic shifting means to move all filter plugs into alignment with each other (i.e., to predetermined axial positions on the conveyor 18) not later than at the locus of transfer of successive plugs 16 into successive flutes of a combined accelerating and inserting conveyor 19. The latter inserts a filter plug 16 of double unit length into each oncoming flute of the assembly conveyor 9, namely into the gap a between the respective pair of coaxial but axially spaced apart plain cigarettes 7*a*, 7*b* of unit length. The thus obtained groups 22 each consist of three coaxial rod-shaped articles, namely two plain cigarettes 7*a*, 7*b* of unit length and a filter plug 16 of double unit length between them. The conveyors 17, 18, 19 can be said to constitute a means for delivering rod-shaped articles (filter plugs 16) of a second type from the source 11 and conveyor 13 to the assembly conveyor 9 whereon the articles 16 are assembled or accumulated with articles 7*a*, 7*b* of the first type to form a series of equidistant groups 22 at a mutual spacing $d_1$. The assembly conveyor 9 (and/or the next-following transfer conveyor 21) cooperates with stationary cams and/or other suitable means for moving the plain cigarette 7*a* and/or 7*b* toward the adjacent axial end of the respective filter plug 16 so that the final axial length of each group 22 equals (or exceeds to a predetermined extent) the combined axial length of two plain cigarettes 7*a*, 7*b* and a filter plug 16. Reference may be had to U.S. Pat. No. 4,605,014 to Wahle.

The magazine 11 contains a mobile partition or pusher 11*a* which ensures that the outlet of the magazine (above the withdrawing conveyor 13) invariably contains a supply of parallel filter rod sections or filter plugs 12 of six times unit length, as long as the magazine 11 is not empty.

The frame of the apparatus 1 supports an expiring bobbin 24 of convoluted tipping paper 23 in the form of a continuous web which advances in the direction of arrow B and one side of which is coated with a suitable adhesive in a paster 26 of conventional design. Reference may be had to U.S. Pat. No. 4,249,547 to Hinzmann. The leader of the web 23 is attracted by suction to the peripheral surface of a rotary cylindrical conveyor 27. The latter is driven at a speed which slightly exceeds the speed of the web 23 in order to ensure that the trailing ends of successively formed uniting bands 29 are spaced apart from the leaders of next-following uniting bands during application of successive uniting bands to successive groups 22 in the flutes of the transfer conveyor 21. Uniting bands 29 are formed by the knives of a rotary cylindrical knife drum 28 (see U.S. Pat. No. 3,340,757 to Rudszinat) which is adjacent the conveyor 22 and is driven at the same speed. One mode of splicing the web 23 to a fresh web 23*a* is disclosed in U.S. Pat. No. 3,586,806 to Wendt.

Each uniting band 29 is applied to the respective group 22 in such a way that it adheres to the respective filter plug 16 as well as to the adjacent inner end portions of the respective plain cigarettes 7*a*, 7*b* of unit length. Such groups 22 (each of which carries a uniting band 29) are transferred into successive flutes of a rotary conveyor 31 constituting one part of a rolling or convoluting mechanism which further includes a rolling member 32. The conveyor 31 cooperates with the rolling member 32 to convolute each uniting band 29 around the respective filter plug 16 and around the adjacent end portions of the respective plain cigarettes 7*a*, 7*b* to convert the group 22 in to a group 33 of connected rod-shaped articles, namely into a filter cigarette of double unit length. Wrapping or rolling mechanisms which can be used in the apparatus of the present invention are disclosed, for example, in U.S. Pat. No. 3,483,873 to Hinzmann, in U.S. Pat. No. 3,527,234 to Hinzmann, and in U.S. Pat. No. 4,969,551 to Heitmann et al.

Figure 2A:
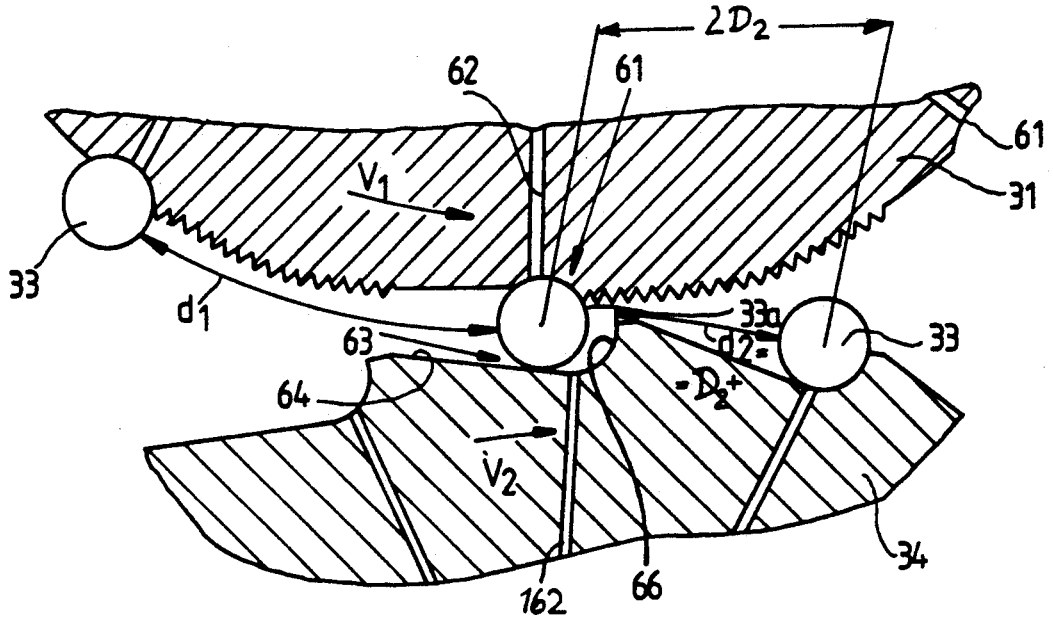
FIG. 2*a* is an enlarged fragmentary vertical sectional view of a first distance reducing device which can be used in the apparatus of FIG. 1 to reduce the spacing between successive groups of interconnected coaxial rod-shaped articles immediately upstream of a station where the groups are severed to yield pairs of mirror symmetrical discrete rod-shaped articles, a group of connected articles being shown at a transfer station between the two rotary drum-shaped conveyors of the reducing device.
Figure 2B:
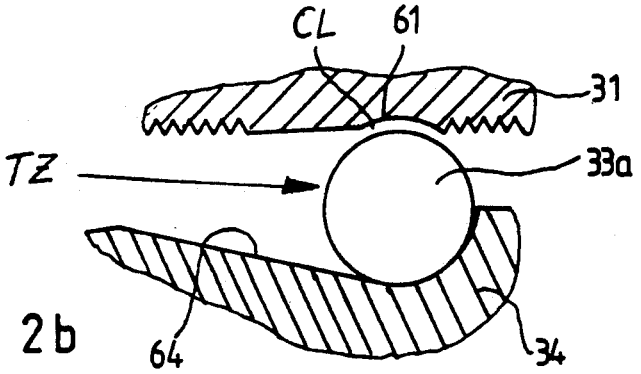
FIG. 2*b* illustrates a portion of the structure of FIG. 2*a* during a further stage of transfer of a group of articles from the first onto the second conveyor.
Figure 2C:
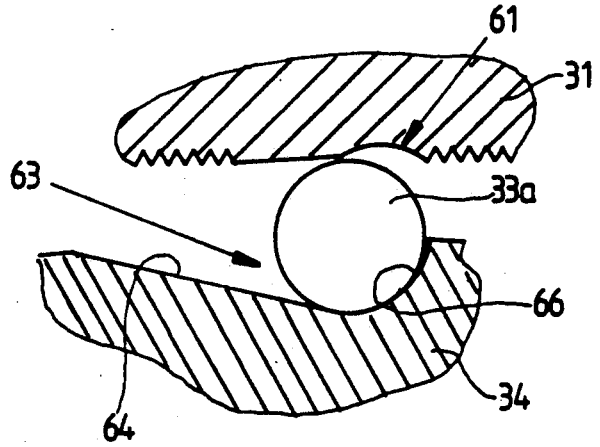
FIG. 2*c* illustrates the structure of FIG. 2*b* during another stage of transfer of a group onto the second conveyor.

Filter cigarettes 33 of double unit length are transferred into the flutes of a rotary conveyor 34 which, together with the rolling conveyor 31, constitutes a first distance- or spacing-reducing device 30 of a composite two-stage distance- or spacing reducing means 30, 45 forming part of the improved apparatus 1. The details of the reducing device 30 are shown in FIGS. 2*a*, 2*b* and 2*c*.

The conveyor 34 delivers successive filter cigarettes 33 of double unit length (at a reduced spacing $d_2$) into successive flutes of a rotary severing or subdividing conveyor 36 which cooperates with a rotary circular disc-shaped knife 37 to sever each cigarette 33 midway across is convoluted uniting band 29 (i.e., midway across the filter plug 16 of double unit length) so that each cigarette 33 yields two coaxial filter cigarettes (rod-shaped smokers' products) 38*a*, 38*b* of unit length. The cigarettes 38*a* form a first row of equidistant parallel cigarettes, and the cigarettes 38*b* form a second row of equidistant parallel cigarettes. A severing device which can be used in the apparatus 1 to subdivide the plain cigarettes 3, the filter plugs 12 or the filter cigarettes 33 is disclosed in U.S. Pat. No. 3,063,480 to Hinzmann.

Successive pairs of coaxial cigarettes 38*a*, 38*b* are delivered into oncoming flutes of a spreading conveyor 39 which is analogous to the conveyor 8 and serves to move the two rows of cigarettes 38*a*, 38*b* axially of the cigarettes and away from each other and to thus establish an axial clearance or gap b. The width of the illustrated gap b is less than the length of a filter plug 16 of double unit length. The establishment of gaps b between successive pairs of coaxial cigarettes 38*a*, 38*b* is desirable and advantageous because this simplifies the task of monitoring the characteristics of successive cigarettes 38*a* and successive cigarettes 38*b* on their way toward an orientation changing or turn-around device 47 for successive cigarettes 38*b*. The purpose of the station 47 is to effect inversion of successive cigarettes 38*b* end-for-end so that their filter plugs 116 of unit length face in the same direction as the filter plugs 116 of the non-inverted or non-reoriented cigarettes 38*a*.

The monitoring of successive cigarettes 38*a* and of successive cigarettes 38*b* is carried out in several stages or steps while the cigarettes 38*a*, 38*b* advance with the flutes of two rotary conveyors 41 and 42. The conveyor 41 receives cigarettes 38*a*, 38*b* from the spreading conveyor 39, and the conveyor 42 receives cigarettes 38*a*, 38*b* from the conveyor 41. The monitoring means for successive cigarettes 38*a*comprises two testing units 41*a* at the conveyor 41 and two testing units 42*a* at the conveyor 42 (see FIG. 3). Each of the conveyors 41, 42 can comprise two coaxial axially spaced apart sections, one for the row of cigarettes 38*a* and the other for the row of cigarettes 38*b*.

For example, the testing devices 41*a* can be designed to mointor The hardness of the heads of the respective filter cigarettes 38*a*, 38*b* (see U.S. Pat. No. 4,901,860 to Wahle et al.), i.e., the hardness of those end portions which contain tobacco shreds or other fragments of smokable material. The testing devices 42*a* can include pneumatic monitoring means (see U.S. Pat. No. 4,662,214 to Heitmann et al.) which serve to ascertain the condition of the wrappers (such as the presence or absence of holes, open seams, frayed ends and/or other defects of the wrappers for tobacco particles and filter material), the rate at which the wrappers permit penetration of atmospheric air into the column of tobacco smoke when the cigarette 38*a* or 38*b* is lighted, resistance to the flow of smoke from the tobacco-containing portion toward the mouth of the smoker and/or other important characteristics of the rod-shaped products 38*a*, 38*b*. The exact details of the monitoring means including the testing devices 41*a*, 42*a* (one of each for the cigarettes 38*a* and one of each for the cigarettes 38*b*) form no part of the present invention. Suitable testing devices are used in presently known filter tipping machines, e.g., in those known as MAX 90 which are produced and distributed by the assignee of the present application. Reference may also be had to numerous United States and foreign patents of the assignee. Certain testing devices which can be used in the apparatus of the present invention are described and shown in U.S. Pat. No. 4,648,412 to Heitmann, in U.S. Pat. No. 4,645,921 to Heitmann et al., in U.S. Pat. No. 4,193,409 to Wahle et al., and in U.S. Pat. No. 4,277,678 to Wahle et al.

Freshly tested cigarettes 38*a*, 38*b* are transferred into the flutes of an intermediate conveyor 43 which, in turn, delivers the cigarettes into the flutes of a transfer conveyor 44. The latter transfers the cigarettes 38*a*, 38*b* onto a further intermediate conveyor 46 which forms part of a combined shuffling and reorienting unit for the filter cigarettes 38*b*. The reorienting station 47 accommodates an inverting or turn-around mechanism 48 of the type shown in FIG. 4. The mechanism 48 turns successive cigarettes 38*b* end-for-end and simultaneously shifts the cigarettes 38*b* axially so that they are aligned with the cigarettes 38*a*. The shuffling device of the aforementioned combined shuffling and reorienting unit includes a conveyor 49 having flutes some of which receive successive non-inverted cigarettes 38*a*from a conveyor 51 which receives such cigarettes from the conveyor 44. The inverted cigarettes 38*b* are delivered into alternate flutes of the conveyor 49 by a conveyor 46*a* which receives such cigarettes from the inverting mechanism 48.

Figure 4:
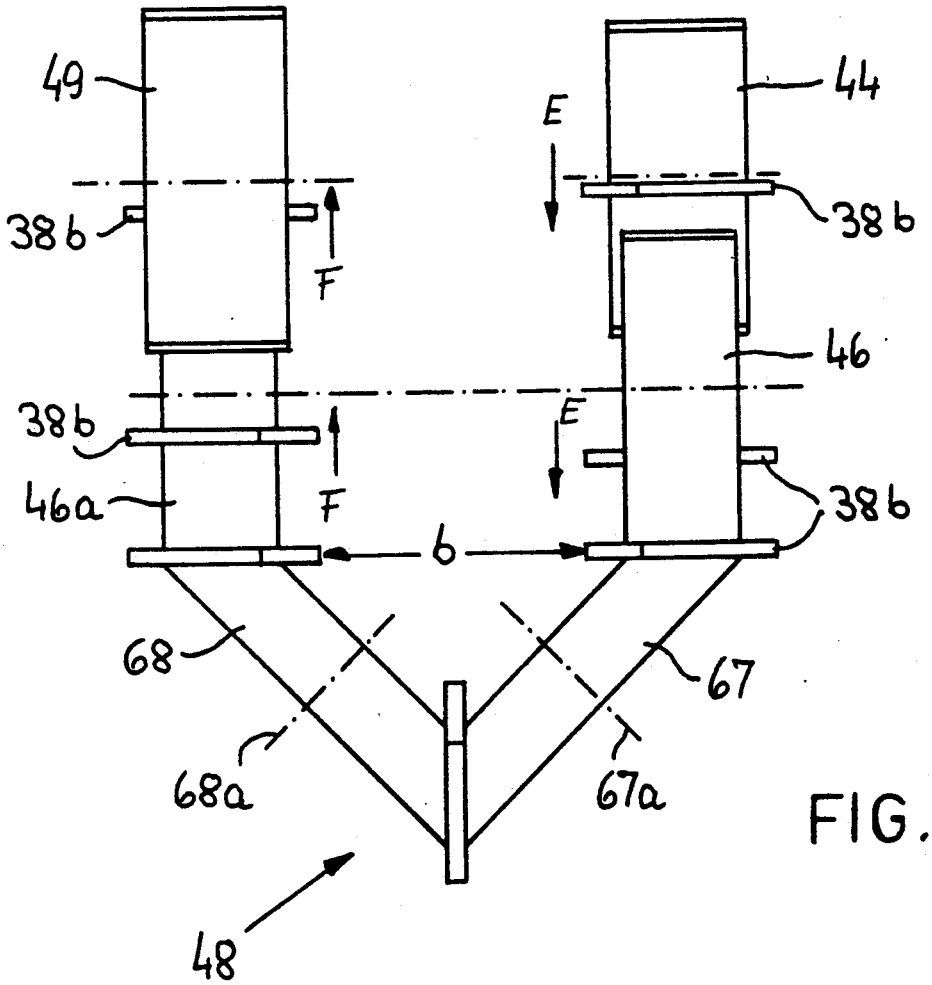
FIG. 4 is an enlarged view of a reorienting or inverting unit for discrete rod-shaped articles of the one row as seen in the direction of arrow IV in FIG. 1.

The inverting mechanism 48 of FIG. 4 is of the type known, for example, from published German patent application No. 20 20 138. However, other types of turn-around or inverting mechanisms can be used with equal or similar advantage. Reference may be had, for example, to the aforementioned U.S. Pat. No. 3,176,825 to Rudszinat, to the aforementioned U.S. Pat. No. 3,583,546 to Koop, to U.S. Pat. No. 3,215,250 to Schubert or to U.S. Pat. No. 4,090,602 to Schubert et al. The inverting mechanism 48 delivers successive inverted cigarettes 38*b* into the flutes of the conveyor 46*a* which is coaxial with the conveyor 46. As mentioned above, alternate flutes of the shuffling conveyor 49 receive cigarettes 38*a*from the conveyor 51 (i.e., from the conveyor 44), and the remaining flutes of the conveyor 49 receive inverted cigarettes 38*b* from the conveyor 46*a*. The cigarettes 38*a*, 38*b* in the flutes of the conveyor 49 form a single row wherein the filter plugs 116 of all cigarettes face in the same direction so that such cigarettes are ready to be introduced into a packing machine or into storage.

The conveyor 49 delivers successive cigarettes 38*a*, 38*b*, 38*a* . . . of the single row into successive flutes of an intermediate conveyor 523 which, in turn, delivers the single row of cigarettes onto the upper reach of an endless belt conveyor 53. The latter delivers the single row of cigarettes into a conveyor 54 which is designed to deliver a mass flow (i.e., a multi-layer stream) of cigarettes into a packing machine or into storage in a manner not forming part of the present invention. Reference may be had to U.S. Pat. No. 3,885,683 to Bornfleth et al., to U.S. Pat. No. 4,365,702 to Tolasch et al.

and U.S. Pat. No. 4,339,026 to Bäse et al. These patents disclose mass-flow conveyors serving to deliver filter cigarettes of unit length into cigarette packing machines.

FIG. 1 further shows a rotary cylindrical or drum-shaped conveyor 56 which can be activated (e.g., the suction ports which communicate with its flutes can be connected to a suction generating device, not shown) to remove a selected number of successive groups 22 form the flutes of the assembly conveyor 9 for transfer onto the upper reach of an endless belt conveyor 58. The conveyor 58 can transfer the deposited groups 22 onto a collecting conveyor 59 which transfers the rod-shaped articles of such groups into a laboratory, not shown, or into a receptacle of the collection of rejects.

A rotary cylindrical or drum-shaped conveyor 57 can accept (when desired or necessary) a selected number of successive filter cigarettes 38*a* and/or 38*b* from the conveyor 43 for transfer onto the belt conveyor 58 and for subsequent transport into the laboratory, or to a waste collecting receptacle, via conveyor 59.

As can be seen in FIG. 3, the apparatus 1 of FIG. 1 is designed to reduce the spacing d of successive rod-shaped articles in two successive stages, first in a path portion between the path portion for the conveyors 31, 32 and the path portion for the conveyor 36 and the associated knife 37, and thereafter in a path portion (accommodating the shuffling conveyor 49) which is located downstream of the path portion for the conveyor 36 and also downstream of the path portion for the two pairs of testing or monitoring units 41*a*, 42*a* and associated fluted conveyors 41, 42. The first stage of the spacing-reducing operation is carried out by the reducing device 30 including the conveyors 31, 34, and the second stage is carried out by a reducing device 45 at the combined orientation changing and shuffling station 47 for filter cigarettes 38*b*.

The reducing device 30 reduces the initial spacing d*1* (i.e., $d_{1m}-D$) to $d_2$ (which equals $d_{2m}-D$ wherein $d_{2m}$ equals the distance between the axes of successive filter cigarettes 33 downstream of the conveyor 34, i.e., downstream of the reducing device 30. The spacing $d_1$is constant (i.e., unchanged) all the way from the conveyor 2 to the conveyor 31 (namely on the conveyors 4, 8, 9, 21 and 31), and the spacing $d_2$ is constant between the reducing devices 30 and 45, namely on the conveyors 34, 36, 39, 41, 42, 43, 44, 46, 46*a*, 51, part of the conveyor 49 and in the inverting mechanism 48. The second reducing device 45 reduces the spacing $d_2$ to $d_3$ which preferably approximates or only slightly exceeds zero.

The details of a presently preferred form of the first spacing reducing device 30 are shown in FIGS. 2*a*, 2*b* and 2*c*. This device includes the conveyors 31, 34 which rotate about parallel horizontal axes and respectively have axially parallel peripheral article receiving means 61, 63 for the groups 33 of connected articles 7*a*, 16, 7*b*), i.e., for filter cigarettes of double unit length. The conveyors 31, 34 define a transfer zone or transfer station TZ wherein successive cigarettes 33 advance from the respective flutes 61 into the oncoming flutes 63.

As can be seen in FIGS. 2*a* to 2, the flutes 61 in the periphery of the conveyor 31 are relatively shallow (flat) and communicate with suction ports 62 (preferably with rows of suction ports) which are connected to a suction generating device (e.g., the suction intake of a fan) during certain stages of each revolution of the respective flutes 61 about the axis of the conveyor 31 in order to attract cigarettes 33 during transport from the rolling device 32 to the transfer zone TZ.

The conveyor 31 is rotated in a counterclockwise direction as seen in FIGS. 2*a*–2*c* but in a clockwise direction as seen in FIG. 1, and the conveyor 34 is rotated in a clockwise direction (as seen in FIGS. 2*a*–2*c*). The speed ($v_1$) of the conveyor 31 exceeds the speed ($v_2$) of the conveyor 34 to an extent which is necessary to reduce the spacing of successive cigarettes 33 from $d_1$ (on the conveyor 31) to $d_2$ (on the conveyor 34). As can be seen in FIG. 3, the distance or spacing $d_1$ can equal or exceed 2D, and the distance or spacing $d_2$ can equal or slightly exceed D.

As a rule, the apparatus 1 will be designed to produce filter conveyors having a diameter D within a certain range between $D_1$ (minimum diameters) and $D_2$ (maximum diameter). For example, the apparatus 1 can be designed to make filter cigarettes having a diameter D which is as small as 7 mm or as large as 9 mm. The spacings $d_1$, $d_2$ and $d_3$ (as well as the pitches $d_{1m}$, $d_{2m}$ and $d_{3m}$) are selected by full consideration of the maximum diameter $D_2$. By way of example, and assuming that the diameter D of each filter cigarette 38*a* or 38*b* is 9 mm, the spacing $d_2$ (namely the distance between neighboring cigarettes 33 in the flutes 63 of the conveyor 34) can equal or approximately 11.42 mm, i.e., a little more than D=9 mm. The pitch $d_{1m}$ of flutes 61 on the conveyor 31 can equal 37.7 mm, and the pitch $d_{2m}$ of flutes 63 on the conveyor 34 is 20.42 mm, i.e., a little more than half the pitch $d_{1m}$. In other words, the pitch $d_{2m}$ of flutes 63 is approximately or a little more than half the pitch $d_{1m}$ of flutes 61.

Once the spacing of neighboring cigarettes 33 is reduced form $d_1$ to $d_2$, the spacing $d_2$ remains unchanged all the way to the conveyor 49, i.e., to the locus of the second reducing device 45 which includes the shuffling means 46, 46*a*, 49, 51 of the apparatus 1.

The upstream side of each flute 63 is bounded by a first flank 64 which extends substantially tangentially of the respective conveyor 34, and the downstream side of each flute 63 is bounded by a steeper (substantially radially extending) slightly concave flank 66 of the conveyor 34. When a freshly transferred cigarette 33 is properly seated in the respective flute 63, it abuts the downstream flank 66 of such flute. The flanks 64 establish optimal paths for advancement of freshly transferred cigarettes 33 toward and against the respective flanks 66; such cigarettes 33 are then held against the flanks 66 by suction in the ports 162 which are machined into the body of the conveyor 34. The suction ports 62 and 162 are omitted in FIGS. 2*b* and 2*c*.

FIG. 2*a* shows a filter cigarette 33*a* of double unit length in the respective flute 61 of the conveyor 31 adjacent the tangential flank 64 of the nearest flute 63 of the conveyor 34. The cigarette 33*a* is spaced apart from the radially extending downstream flank 66 of such neighboring flute 63. This cigarette is still attracted by suction in the respective port or ports 62 of the conveyor 31, and its distance from the radial flank 66 of the neighboring flute 63 is on the decrease because the peripheral speed $v_1$ of the conveyor 31 is greater than the peripheral speed $v_2$ of the conveyor 34.

FIG. 2*b* shows the filter cigarette 33*a* immediately after completed transfer across the zone TZ and in close or immediate proximity to the downstream flank 66 of its flute 63. A small clearance CL can be seen between the freshly transferred cigarette 33*a* and the surface bounding the adjacent (freshly emptied) flute 61 of the conveyor 31. Thus, the distance of two neighboring flutes 61, 63 immediately prior, during and subsequent to transfer of a cigarette 33*a* from the flute 61 into the flute 63 is greater than D (the diameter of the cigarette 33*a*) so that, during transfer in the zone TZ, a cigarette 33*a* has a component of movement radially of the conveyor 31 as well as radially of the conveyor 34. In other words, the transfer of successive cigarettes 33 from the conveyor 31 onto the conveyor 34 does not take place exactly tangentially of the conveyor 31 or 34 but rather along a path wherein the cigarettes perform a movement having a component radially of the conveyor 31 as well as radially of the conveyor 34. Stated in another way, a cigarette (33*a*) which has reached the transfer zone TZ must "jump" from the respective flute 61 of the conveyor 31 into the oncoming (nearest) flute 63 of the conveyor 34.

FIG. 2*c* shows the cigarette 33*a* during the next stage of movement of its flute 63 in a clockwise direction. At such time, the suction port or suction ports 62 which communicate with the nearest (freshly emptied) flute 61 of the conveyor 31 are disconnected from the suction generating device but the suction port or ports 162 which communicate with the freshly filled flute 63 are in communication with the same or with a different suction generating device in order to ensure that the cigarette 33*a* continues to abut the radially extending flank 66 of its flute 66 during advancement with the conveyor 34 toward the transfer station between the conveyors 34 and 36. FIG. 2*c* further shows that, since the speed $v_1$ exceeds the speed $v_2$, the freshly emptied flute 61 overtakes the freshly filled flute 63 on its way back toward the transfer station between the conveyors 21, 31 where the flute 61 receives a fresh filter cigarette 33 of double unit length for transport first past the rolling member 32 and on toward the transfer zone TZ.

An advantage of the illustrated design of the surfaces bounding the flutes 61 and 63 is that, when a freshly emptied flute 61 overtakes the freshly transferred cigarette 33*a* in its flute 63, the conveyor 31 does not contact and cannot deface and/or otherwise damage the freshly transferred cigarette 33*a* in spite of the fact that the speed $v_1$ is greater than the speed $v_2$. Thus, the transfer of successive filter cigarettes 33 in the zone TZ is carried out gently even though the cigarettes 33 are or can be moved sideways at a considerable speed. Such transfer takes place simultaneously with a pronounced reduction of the spacing of successive cigarettes 33 from $d_1$ to $d_2$, e.g. (and as mentioned above) with a reduction which involves halving of the original spacing $d_1$.

The second reducing device 45 is operative downstream of the testing units 41*a*, 42*a* and downstream of the inverting mechanism 48 to reduce the spacing of cigarettes 38*a*, 38*b* from $d_2$ to $d_3$, preferably in such a way that the thus obtained spacing ($d_3$) is close to zero or only slightly in excess of zero. As mentioned above, the reducing device 45 includes the shuffling means 46, 46*a*, 49, 51 or vice versa, i.e., the spacing $d_3$ between successive cigarettes 38*a*, 38*b*, 38*a* . . . of the single row of rod-shaped smokers' products which is formed in the flutes of the shuffling conveyor 49 is obtained by placing successive inverted or reoriented cigarettes 38*b* between successive pairs of non-inverted cigarettes 38*a*.

An advantage of the single row of alternating cigarettes 38*a* and 38*b* in the flutes of the conveyor 49 (with a mutual spacing $d_3$ which is close to zero) is that such row or stream of cigarettes can be gently admitted into the mass flow in the conveyor 54 (by way of the rotary drum-shaped conveyor 52 and endless belt conveyor 53). As a rule, the spacing $d_3$ will be close to but in excess of zero (e.g., 1.2 mm when the diameter D of the articles 38*a*, 38*b* is 9 mm). Thus, the pitch $d_{3m}$ of flutes in the periphery of the shuffling conveyor 49 can approximate or only slightly exceed D. In other words, $d_{3m}$ can equal or approximate one-half of $d_{2m}$, and $d_{2m}$ can equal or approximate one-half of $d_{1m}$. The first reducing step is carried out at a rather early stage of filter cigarette making, i.e., close to the path portion for the conveyor 31 and rolling member 32 (these parts cooperate to convert the groups 22 of unconnected coaxial rod-shaped articles 7*a*, 16, 7*b* into groups 33 of connected rod-shaped articles), and the second reducing step is carried out closer to the combined shuffling and orientation changing means of the apparatus 1, i.e., close to the discharge end of the apparatus and subsequent to completed making, testing and inverting of rod-shaped smokers' products (cigarettes 38*a*, 38*b*).

FIG. 1 shows that the non-inverted cigarettes 38*a* are transported from the conveyor 44 onto the conveyor 49 by way of a discrete rotary cylindrical or drum-shaped conveyor 51, and that the freshly inverted cigarettes 38*b* are delivered to the shuffling conveyor 49 by a discrete rotary drum-shaped or cylindrical conveyor 46 which is coaxial with the conveyor 46*a* (see FIG. 4). The reoriented or inverted cigarettes 38*b* in the flutes of the conveyor 46*a* are already aligned with the non-inverted cigarettes 38*a*, i.e., the ends of the cigarettes 38*b* do not extend axially beyond the ends of the cigarettes 38*a*. This is due to the fact that the change of orientation of a cigarette 38*b* entails an axial shifting of such cigarette through a distance b plus the length of a cigarette 38*a* or 38*b*. In the apparatus 1 which is shown in FIG. 1, the transfer station between the conveyors 46*a*, 49 is located upstream of the transfer station between the conveyors 49, 51, i.e., the cigarettes 38*b* are already located in alternate flutes of the conveyor 49 when the remaining flutes of this conveyor receive cigarettes 38*a* from the conveyor 51.

Since the inverted cigarettes 38*b* are aligned with the cigarettes 38*a* prior to transfer of these cigarettes into the flutes of the shuffling conveyor 49, the spacing $d_3$ between neighboring flutes of the conveyor can be close to zero which is desirable for the aforediscussed reasons, for example, because a row or stream of closely or immediately adjacent cigarettes 38*a*, 38*b*, 38*a*, . . . can be transferred into a mass flow in the conveyor 54 without adversely affecting the appearance and/or other desirable characteristics of transferred cigarettes.

The inverting mechanism 48 employs two conical conveyors 67 and 68. Were the conveyor 67 or 68 used as a means for introducing the inverted cigarettes 38*b* into the flutes of the conveyor 49, the spacing of such flutes would have to be greater the $d_3$ due to the very nature of inverting or reorienting operation which is being carried out with a mechanism employing conical conveyors. On the other hand, an inverting mechanism which employs conical conveyors is often desirable or necessary because it is relatively simple, compact and rugged as well as because it renders it possible to carry out the inverting operation with a high degree of precision, at a high speed and without damage to the cigarettes 38*b*.

FIG. 4 shows that the flutes of the right-hand rotary conical conveyor 67 of the inverting mechanism 48 receive successive filter cigarettes 38*b* from successive flutes of the conveyor 46 and transfer the thus received cigarettes 38*b* into the flutes of the second conical conveyor 68. The axes 67*a*, 68*a* of the illustrated conical conveyors 67, 68 make an angle which approximates or equals 90°. One-half of the inverting operation is carried out by the conveyor 67, and the other half of such operation is performed by the conveyor 68. The latter delivers freshly inverted cigarettes 38*b* (each of which has been turned end-for-end) to successive flutes of the cylindrical conveyor 46*a* which is coaxial (and can be driven jointly) with the conveyor 46. The conveyor 46*a* delivers successive inverted cigarettes 38*b* into alternate flutes of the shuffling conveyor 49.

The arrows E denote if FIG. 4 the direction of sidewise transport of cigarettes 38*b* toward the first conical conveyor 67, and the arrows F indicate the direction of sidewise transport of inverted cigarettes 38*b* on the conveyors 46*a* and 49. FIG. 4 further shows that the dimensions of the conveyors 67, 68 are selected with a view to ensure that the freshly inverted cigarettes 38*b* on the conveyor 46*a* are axially spaced apart form non-inverted cigarettes 38*b* on the conveyor 46 a distance b, i.e., the same distance which is established on the conveyor 39 for the purpose of facilitating multiple testing of successive cigarettes 38*a* independently of the cigarettes 38*b* and vice versa. The axial shifting as a result of transfer of cigarettes 38*b* during transport (by the conical drums 67, 68) from the conveyor 46 onto the coaxial conveyor 46*a* is desirable and necessary to form a single row wherein the cigarettes 38*a* alternate with the cigarettes 38*b* and neighboring cigarettes 38*a*, 38*b* of the single row are immediately or closely adjacent each other to facilitate problem-free introduction of such single row or stream of rod-shaped smokers' products into the mass flow in the conveyor 54.

An important advantage of the improved method and apparatus is that the rod-shaped articles can be treated gently irrespective of their diameter and irrespective of the number of testing or monitoring operations which are performed upon rod-shaped articles on the conveyors 41 and 42. Furthermore, the output of the apparatus can be increased without affecting the quality of the ultimate products. Alternatively, and if the output is not increased, the improved method and apparatus render it possible to treat the articles gently, i.e., in a manner to further reduce the likelihood of damage such as tearing of wrappers, deformation, fraying of the ends of wrappers, losses of tobacco particles at the tobacco-containing ends of cigarettes 33 or 38*a*, 38*b* and/or other damage. Furthermore, if the speed is not increased, the provision of separate paths for the rows of cigarettes 38*a*, 38*b* during testing on the conveyors 41, 42 enhances the quality of the testing or monitoring operations because longer intervals of time are available for the testing or discrete cigarettes. The magnitude of forces which act upon the rod-shaped articles during transport from the sources 2, 11 to the conveyor 54 is not increased, even if the output of the apparatus 1 is increased as a result of one or two reductions of spacing between successive rod-shaped articles. The absence of pronounced mechanical stresses is particularly important and desirable at the locus of introduction of the single row or stream of articles 38*a*, 38*b* into the mass flow in the conveyor 54. As already mentioned above, the cigarettes 38*a*, 38*b* of the single row or stream wherein such articles or products are closely or immediately adjacent each other are much less likely to be deformed, defaced and/or otherwise damaged during introduction into the mass flow in the conveyor 54 than the cigarettes of a stream wherein successive cigarettes are separated by distances $d_1$ as is customary in presently known filter tipping machines. This holds true even if the speed of cigarettes 38*a*, 38*b* in the single row or stream on the conveyor 53 considerably exceeds the speed of cigarettes which are produced in a conventional filter tipping machine and are being admitted into a mass flow.

Another important advantage of the improved method and apparatus is that the quality of rod-shaped products is not affected if it becomes necessary to switch from the making of larger-diameter cigarettes to the making of smaller-diameter cigarettes or the other way around. All that happens is that the spacings $d_1$, $d_2$ and $d_3$ are changed if the diameters of the articles are changed. Thus, the spacings are increased if the diameters of the articles are reduced (e.g., from 9 mm to 7 mm).

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of making rod-shaped products of the tobacco processing industry, such as filter cigarettes, comprising the steps of accumulating a series of spaced-apart parallel groups each of which is composed of several coaxial rod-shaped articles; conveying the groups sidewise substantially at right angles to their axes in a predetermined direction along an elongated path; connecting the articles of successive groups to each other with uniting bands in a first portion of said path; subdividing successive groups of connected articles into pairs of discrete first and second rod-shaped articles in a second portion of said path downstream of said first portion so that the first articles form a first row of articles having a first orientation and the second articles form a second row of articles having a different second orientation; and changing the orientation of discrete articles in one of said rows and shuffling the thus reoriented articles with the articles of the other row to form a single row of discrete articles in a third portion of said path downstream of said second portion, said conveying step including reducing the spacing of successive articles in said path and thereupon transporting the articles at the reduced spacing from one another, said reducing step being carried out in several successive stages including a first stage of reducing the spacing of successive articles to a first extent and a second stage of reducing the once reduced spacing.

2. The method of claim 1, wherein the groups in said first portion of said path are spaced apart from each other a first distance and said first stage includes reducing the first distance to a second distance which is substantially half the first distance, said second stage including reducing the second distance to a third distance which is substantially half the second distance.

3. The method of claim 1 of making rod-shaped products with a diameter in the range of $D_1$ to $D_2$, wherein the groups in said first portion of said path are spaced apart from each other a first distance greater than $D_2$ and said reducing step includes reducing the first distance to a second distance which at least approximates $D_2$.

4. The method of claim 1, further comprising the steps of moving at least one article of each pair of discrete first and second articles axially and away from the other discrete article of each pair in another portion of said path prior to said shuffling step and thereupon monitoring at least one characteristic of successive discrete articles in each of said rows.

5. The method of claim 4, wherein said monitoring step includes monitoring several different characteristics of successive discrete articles in each of said rows in a plurality of successive stages.

6. Apparatus for making rod-shaped products of the tobacco processing industry, such as filter cigarettes, comprising means for accumulating a series of spaced-apart parallel groups of several coaxial rod-shaped articles; means for conveying the groups sidewise substantially at right angles to their axes in a predetermined direction along an elongated path; means for connecting the articles of successive groups to each other with united bands in a first portion of said path; means for subdividing successive groups of connected articles into pairs of discrete first and second rod-shaped articles in a second portion of said path downstream of said first portion so that the first articles form a first row of articles having a first orientation and the second articles form a second row of articles having a different second orientation; and means for changing the orientation of discrete articles in one of said rows and for shuffling the thus reoriented articles with the articles of the other row to form a single row of discrete articles in a third portion of said path downstream of said second portion, said conveying means including means for reducing at least once the spacing of successive articles in said path, said reducing means comprising a first circulating conveyor having a plurality of equidistant first peripheral receptacles for rod-shaped articles and a second circulating conveyor having a plurality of equidistant second receptacles for rod-shaped articles, said second receptacles being nearer to each other than said first receptacles and said conveyors defining a transfer zone wherein rod-shaped articles are transferred from successive first receptacles into successive second receptacles.

7. The apparatus of claim 6, wherein said accumulating means comprises at least two sources of different rod-shaped articles, an assembly unit, and means for delivering articles from said sources to said unit.

8. The apparatus of claim 6, wherein said conveyors are rotatable about parallel axes and said receptacles are parallel to the axes of said conveyors.

9. The apparatus of claim 6 for making rod-shaped products with a diameter in the range of $D_1$ to $D_2$, wherein the axes of articles in said equidistant second receptacles are spaced apart from each other a distance which approximates or slightly exceeds $2D_2$.

10. The apparatus of claim 6 for making rod-shaped products with a diameter in the range of $D_1$ to $D_2$, wherein the articles in said equidistant second receptacles are spaced apart from each other a distance which approximates or slightly exceeds $D_2$.

11. The apparatus of claim 6 for making rod-shaped products having a diameter D, wherein a first and a second receptacle at said transfer zone are spaced apart from each other a distance which is greater than D.

12. The apparatus of claim 6, wherein said first conveyor includes a rotary drum and said first receptacles are shallow flutes provided in the periphery and parallel to the axis of rotation of said drum, said drum having suction ports arranged to attract articles into said flutes.

13. The apparatus of claim 6, wherein said second conveyor includes a rotary drum and said second receptacles are flutes provided in the periphery and parallel to the axis of said drum.

14. The apparatus of claim 13, wherein said drum is rotatable in a preselected direction and comprises substantially tangential first flanks bounding the upstream portions and substantially radial second flanks bounding the downstream portions of said flutes in said preselected direction.

15. The apparatus of claim 6, wherein said conveying means further comprises means for transporting the articles at not more than the reduced spacing in all portions of said path downstream of said reducing means.

16. The apparatus of claim 6, further comprising means for monitoring the characteristics of discrete articles of said first and second rows in a fourth portion of said path between said second and third portions, said reducing means including a reducing device downstream of said fourth portion of said path.

17. The apparatus of claim 16, wherein said reducing device includes said shuffling means.

18. The apparatus of claim 17, wherein said shuffling means includes means for transferring reoriented articles of said one row into said other row.

19. The apparatus of claim 18, wherein the spacing of discrete articles in said other row at least equals the diameters of articles of said one row.

20. The apparatus of claim 19, wherein said reducing device comprises a cylindrical conveyor arranged to transfer successive articles of said one row to said orientation changing means and said orientation changing means comprises cooperating conical conveyors having means for inverting the articles of the one row end-for-end and for delivering inverted articles of the one row to said shuffling means.

21. The apparatus of claim 20, wherein said conical conveyors include means for moving the articles of said one row axially into alignment with the articles of said other row in the course of inversion of articles of said one row end-for-end.

22. The apparatus of claim 21, wherein said conveying means comprises a further conveyor having means for receiving the articles of said other row and the inverted and axially shifted articles of said one row.

23. The apparatus of claim 22, wherein said shuffling means further comprises a conveyor which delivers the articles of said other row to said further conveyor.

24. The apparatus of claim 23, wherein said further conveyor includes a rotary drum having axially parallel peripheral flutes for reception of discrete articles of said other row and inverted and axially shifted articles of said one row.

25. A method of making rod shaped products of the tobacco processing industry, such as filter cigarettes, comprising the steps of accumulating a series of spaced-apart parallel groups each of which is composed of several coaxial rod-shaped articles; conveying the groups sidewise substantially at right angles to their axes in a predetermined direction along an elongated path; connecting the articles of successive groups to each other with uniting bands in a first portion of said path; subdividing successive groups of connected articles into pairs of discrete first and second rod-shaped articles in a second portion of said path downstream of said first portion so that the first articles form a first row of articles having a first orientation and the second articles form a second row of articles having a different second orientation; and changing the orientation of discrete articles in one of said rows and shuffling the thus reoriented articles with the articles of the other row to form a single row of discrete articles in a third portion of said path downstream of said second portion, said conveying step including reducing at least once the spacing of successive articles in said path and thereupon transporting the articles at the reduced spacing from one another, said reducing step being carried out in a further portion of said path between said first and second portions.

26. A method of making rod-shaped products of the tobacco processing industry, such as filter cigarettes, comprising the steps of accumulating a series of spaced-apart parallel groups each of which is composed of several coaxial rod-shaped articles; conveying the groups sidewise substantially at right angles to their axes in a predetermined direction along an elongated path; connecting the articles of successive groups to each other with uniting bands in a first portion of said path; subdividing successive groups of connected articles into pairs of discrete first and second rod-shaped articles in a second portion of said path downstream of said first portion so that the first articles form a first row of articles having a first orientation and the second articles form a second row of articles having a different second orientation; and changing the orientation of discrete articles in one of said rows and shuffling the thus reoriented articles with the articles of the other row to form a single row of discrete articles in a third portion of said path downstream of said second portion, said conveying step including reducing at least once the spacing of successive articles in said path and thereupon transporting the articles at the reduced spacing from one another, said reducing step including transporting successive articles on a first rotary conveyor at a first distance from each other and transferring successive articles from the first conveyor onto a second rotary conveyor, said transferring step including moving successive articles in a direction with a component radially of the first conveyor and a component radially of the second conveyor to thereby reduce said first distance to a shorter second distance.

27. A method making rod-shaped products of the tobacco processing industry, such as filter cigarettes, comprising the steps of accumulating a series of spaced-apart parallel groups each of which is composed of several coaxial rod-shaped articles; conveying the groups sidewise substantially at right angles to their axes in a predetermined direction along an elongated path; connecting the articles of successive groups to each other with uniting bands in a first portion of said path; subdividing successive groups of connected articles into pairs of discrete first and second rod-shaped articles in a second portion of said path downstream of said first portion so that the first articles form a first row of articles having a first orientation and the second articles form a second row of articles having a different second orientation; changing the orientation of discrete articles in one of said rows and shuffling the thus reoriented articles with the articles of the other row to form a single row of discrete articles in a third portion of said path downstream of said second portion, said conveying step including reducing at least once the spacing of successive articles in said path and thereupon transporting the articles at the reduced spacing from one another; moving at least one article of each pair of discrete first and second articles axially and away from the other discrete article of each pair in another portion of said path prior to said shuffling step; and thereupon monitoring at least one characteristic of successive discrete articles in each of said rows, said reducing step being carried out in a plurality of successive stages including a first stage prior and a second stage subsequent to said monitoring step.

28. The method of claim 27, wherein said second stage includes reducing the spacing of successive articles at least close to zero.

29. The method of claim 27, wherein said second stage of said reducing step is carried out simultaneously with said shuffling step.

30. The method of claim 29, wherein said second stage includes placing successive reoriented discrete articles of said one row between pairs of successive discrete articles of said other row.

31. Apparatus for making rod-shaped products of the tobacco processing industry, such as filter cigarettes, comprising means for accumulating a series of spaced-apart parallel groups of several coaxial rod-shaped articles; means for conveying the groups sidewise substantially at right angles to their axes in a predetermined direction along an elongated path; means for connecting the articles of successive groups to each other with uniting bands in a first portion of said path; means for subdividing successive groups of connected articles into pairs of discrete first and second rod-shaped articles in a second portion of said path downstream of said first portion so that the first articles form a first row of articles having a first orientation and the second articles form a second row of articles having a different second orientation; and means for changing the orientation of discrete articles in one of said rows and for shuffling the thus reoriented articles with the articles of the other row to form a single row of discrete articles in a third portion of said path downstream of said second portion, said conveying means including means for reducing at least once the spacing of successive articles in said path, said reducing means means including a reducing device in a further portion of said path between said first and second portions, said conveying means further comprising means for transporting the articles at no more than the reduced spacing in all portions of said path downstream of said reducing means.

32. The apparatus of claim 31, further comprising means for moving at least one article of each pair of discrete articles axially and away from the other article of the respective pair to establish a gap between the articles of said first and second rows in an additional portion of said path between said second and third portions.

33. The apparatus of claim 32, further comprising means for monitoring the characteristics of discrete articles of said first row and means for monitoring the characteristics of discrete articles of said second row in another portion of said path between said additional portion and said third portion.

34. Apparatus for making rod-shaped products of the tobacco processing industry, such as filter cigarettes, comprising means for accumulating a series of spaced-apart parallel groups of several coaxial rod-shaped articles; means for conveying the groups sidewise substantially at right angles to their axes in a predetermined direction along an elongated path; means for connecting the articles of successive groups to each other with united bands in a first portion of said path; means for subdividing successive groups of connected articles into pairs of discrete first and second rod-shaped articles in a second portion of said path downstream of said first portion so that the first articles form a first row of articles having a first orientation and the second articles form a second row of articles having a different second orientation; and means for changing the orientation of discrete articles in one of said rows and for shuffling the thus reoriented articles with the articles of the other row to form a single row of discrete articles in a third portion of said path downstream of said second portion, said conveying means including means for reducing the spacing of successive articles in said path and said reducing means including a plurality of discrete reducing devices which are spaced apart from each other in said predetermined direction.

35. The apparatus of claim 34, wherein said reducing devices include a first device having means for reducing substantially in half the spacing of successive articles in a portion of said path which is nearer to said first than to said third portion, and a second device having means for reducing substantially in half the once-reduced spacing successive articles in a portion of said path nearer to said third than to said first portion.

36. The apparatus of claim 34, wherein said reducing means includes means for reducing the spacing of successive articles at least close to zero.

* * * * *